US010723503B2

(12) United States Patent
Turner

(10) Patent No.: US 10,723,503 B2
(45) **Date of Patent: *Jul. 28, 2020**

(54) SHIPPING CONTAINER

(71) Applicant: Macro Plastics, Inc., Fairfield, CA (US)

(72) Inventor: Todd T. Turner, Corydon, IN (US)

(73) Assignee: MACRO PLASTICS, INC., Fairfield, CA (US)

( * ) Notice: Subject to any disclaimer, the term of this patent is extended or adjusted under 35 U.S.C. 154(b) by 99 days.

This patent is subject to a terminal disclaimer.

(21) Appl. No.: 15/935,446

(22) Filed: Mar. 26, 2018

(65) Prior Publication Data

US 2018/0208349 A1 Jul. 26, 2018

Related U.S. Application Data

(63) Continuation of application No. 14/785,778, filed as application No. PCT/US2014/038917 on May 21, 2014, now Pat. No. 9,957,078.

(Continued)

(51) Int. Cl.
*B65D 43/02* (2006.01)
*B65D 1/42* (2006.01)

(Continued)

(52) U.S. Cl.
CPC ..... *B65D 1/42* (2013.01); *B65D 19/04* (2013.01); *B65D 25/24* (2013.01); *B65D 1/22* (2013.01);

(Continued)

(58) Field of Classification Search
CPC . B65D 1/22; B65D 1/42; B65D 19/04; B65D 25/24; B65D 2519/00034; B65D 2519/00069; B65D 2519/00174; B65D 2519/00268; B65D 2519/00288; B65D 2519/00318; B65D 2519/00338;

(Continued)

(56) References Cited

U.S. PATENT DOCUMENTS 3,384,263 A * 5/1968 Bernstein ..... B65D 1/22 206/519
3,780,899 A 12/1973 Roper (Continued)

FOREIGN PATENT DOCUMENTS

EP 0827477 B1 8/1999
EP 0976662 * 2/2000 ..... B65D 1/42

(Continued)

OTHER PUBLICATIONS

The United States Patent and Trademark Office; The International Search Report and Written Opinion of PCT/US2014/038917; Search Report and Written Opinion; dated Oct. 8, 2014; pp. 1-13; The United States Patent and Trademark Office; U.S.A.

(Continued)

*Primary Examiner* — Elizabeth J Volz
(74) *Attorney, Agent, or Firm* — Wyatt, Tarrant & Combs, LLP; Matthew A. Williams; Max E. Bridges

(57) ABSTRACT

A shipping container for containing hydraulic loads, said container having a first pair of opposing walls having an convex inner surface and a second pair of opposing walls having a concave inner surface.

3 Claims, 7 Drawing Sheets

Related U.S. Application Data

(60) Provisional application No. 61/826,057, filed on May 22, 2013.

(51) Int. Cl.
*B65D 19/04* (2006.01)
*B65D 25/24* (2006.01)
*B65D 1/22* (2006.01)

(52) U.S. Cl.
CPC ..... *B65D 2519/00034* (2013.01); *B65D 2519/00069* (2013.01); *B65D 2519/0094* (2013.01); *B65D 2519/00174* (2013.01); *B65D 2519/00268* (2013.01); *B65D 2519/00288* (2013.01); *B65D 2519/00318* (2013.01); *B65D 2519/00338* (2013.01); *B65D 2519/00422* (2013.01); *B65D 2519/00497* (2013.01); *B65D 2519/00621* (2013.01); *B65D 2519/00666* (2013.01)

(58) Field of Classification Search
CPC ..... B65D 2519/00422; B65D 2519/00497; B65D 2519/00621; B65D 2519/00666; B65D 2519/0094
USPC ..... 220/604, 659, 669, 656, 657, 658, 675, 220/670, 671, 640; 206/515, 518, 519
See application file for complete search history.

(56) References Cited

U.S. PATENT DOCUMENTS

| | | | | |
|---|---|---|---|---|
| 6,386,388 | B1 | 5/2002 | Overholt | |
| 7,205,016 | B2 | 4/2007 | Garwood | |
| 7,216,769 | B2 | 5/2007 | Palder | |
| 2002/0070223 | A1* | 6/2002 | Elvin-Jensen ..... | B65D 11/10 220/669 |
| 2005/0040068 | A1 | 2/2005 | Palder | |
| 2012/0205341 | A1* | 8/2012 | Mast ..... | B65D 1/0223 215/382 |
| 2013/0019808 | A1 | 1/2013 | Lathim | |

FOREIGN PATENT DOCUMENTS

| | | | |
|---|---|---|---|
| EP | 0976662 | A1 | 2/2000 |
| GB | 609141 | A | 9/1948 |

OTHER PUBLICATIONS

Cecor; Multi-Use Poly Bin; Product Sheet; 2014; pp. 49-50; Cecor, Verona, WI; USA; www.cecor.net; cecor@cecor.net.

* cited by examiner

SHIPPING CONTAINER

CROSS-REFERENCE TO RELATED APPLICATIONS

This continuation patent application claims the benefit of and priority to U.S. patent application Ser. No. 14/785,778, which was filed on Oct. 20, 2015, which claims priority as a national stage patent application, under 35 U.S.C. § 371, that claims the benefit of and priority to PCT Application Number PCT/US14/38917, which was filed on May 21, 2014, which claims the benefit of and priority to U.S. Provisional Application No. 61/826,057, which was filed on May 22, 2013.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention generally relates to returnable shipping containers and more specifically to returnable shipping containers capable of withstanding hydraulic loads from liquid, partially liquid, and other types of amorphous loads.

2. General Background of the Invention

For many years, industries dealing in bulk goods have utilized returnable containers. Some industries, in particular those involving liquid, partially liquid, and other types of amorphous loads, have been limited in their ability to take advantage of returnable shipping containers. The reason for this is that economical container designs using smooth, moldable walls without intricate reinforcing ribbing have been unable to effectively withstand hydraulic loading of the container. For example, in many cases such loads are often packed in shipped in octagonal corrugated containers that are reinforced against failure using strapping around the outer wall of the container. Despite the facts that (i) such containers are subject to failure if the strapping gets nicked or cut, (ii) octagonal containers do not load efficiently into rectangular trailers, and (iii) such containers create significant waster to be disposed of, heretofore such single-use shipping containers have been more economical than returnable shipping containers.

What is needed then is an economical returnable shipping container that can be formed with smooth walls that do not required extensive reinforcing ribbings that can withstand hydraulic loading with liquid, loads partially liquid loads, and other types of amorphous loads.

SUMMARY OF THE INVENTION

The present invention relates to a reusable shipping container having a first pair of opposing convex walls and a second pair of opposing concave walls to enable said shipping container to withstand hydraulic loading of the container with liquid, partially liquid, and other types of amorphous loads.

BRIEF DESCRIPTION OF THE DRAWINGS

For a further understanding of the nature, objects, and advantages of the present invention, reference should be had to the following detailed description, read in conjunction with the attached figures, wherein like reference numerals denote like elements.

DETAILED DESCRIPTION OF THE INVENTION

Figure 1:
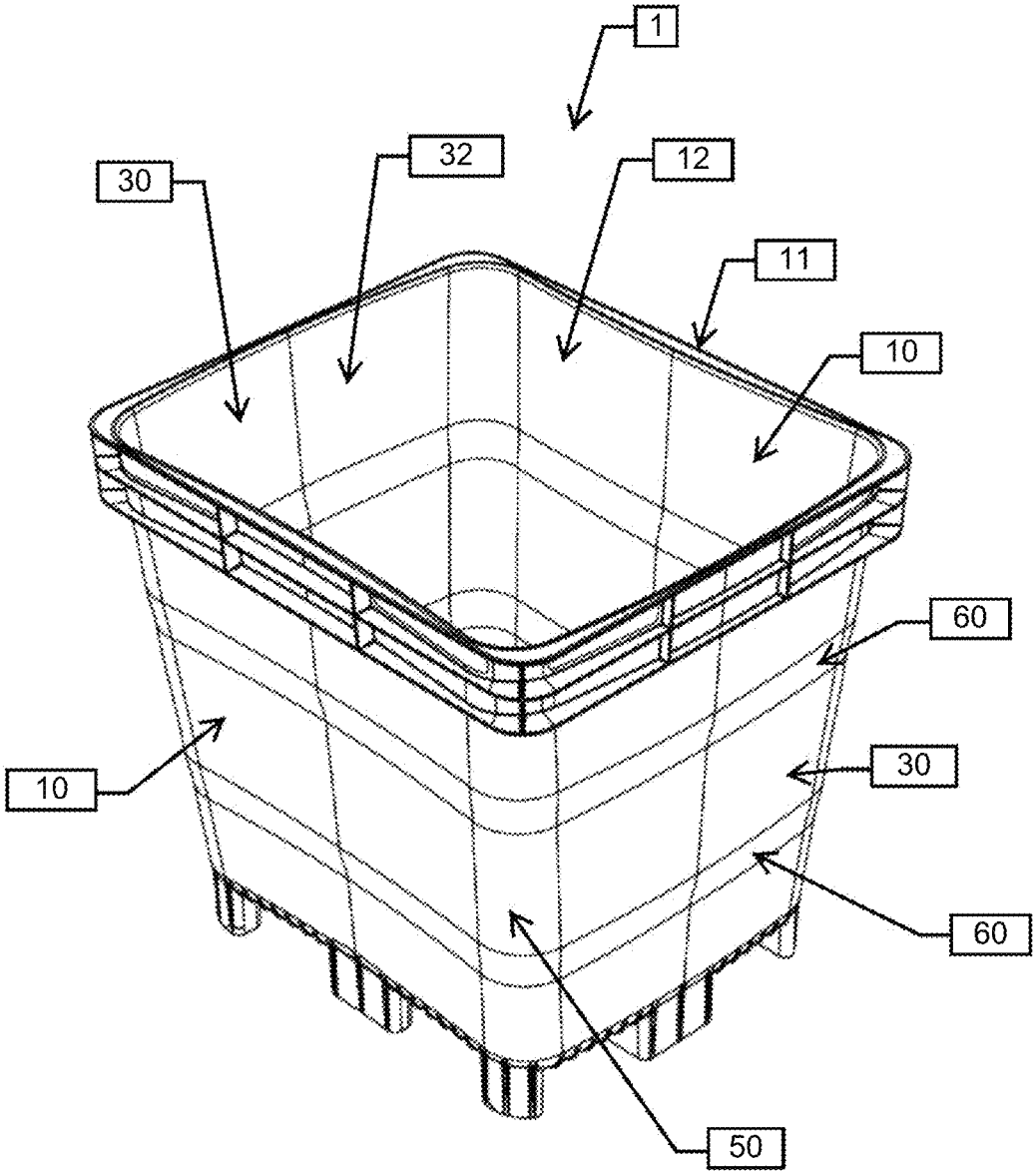
FIG. 1 is a perspective view of an embodiment of the present invention.
Figure 2:
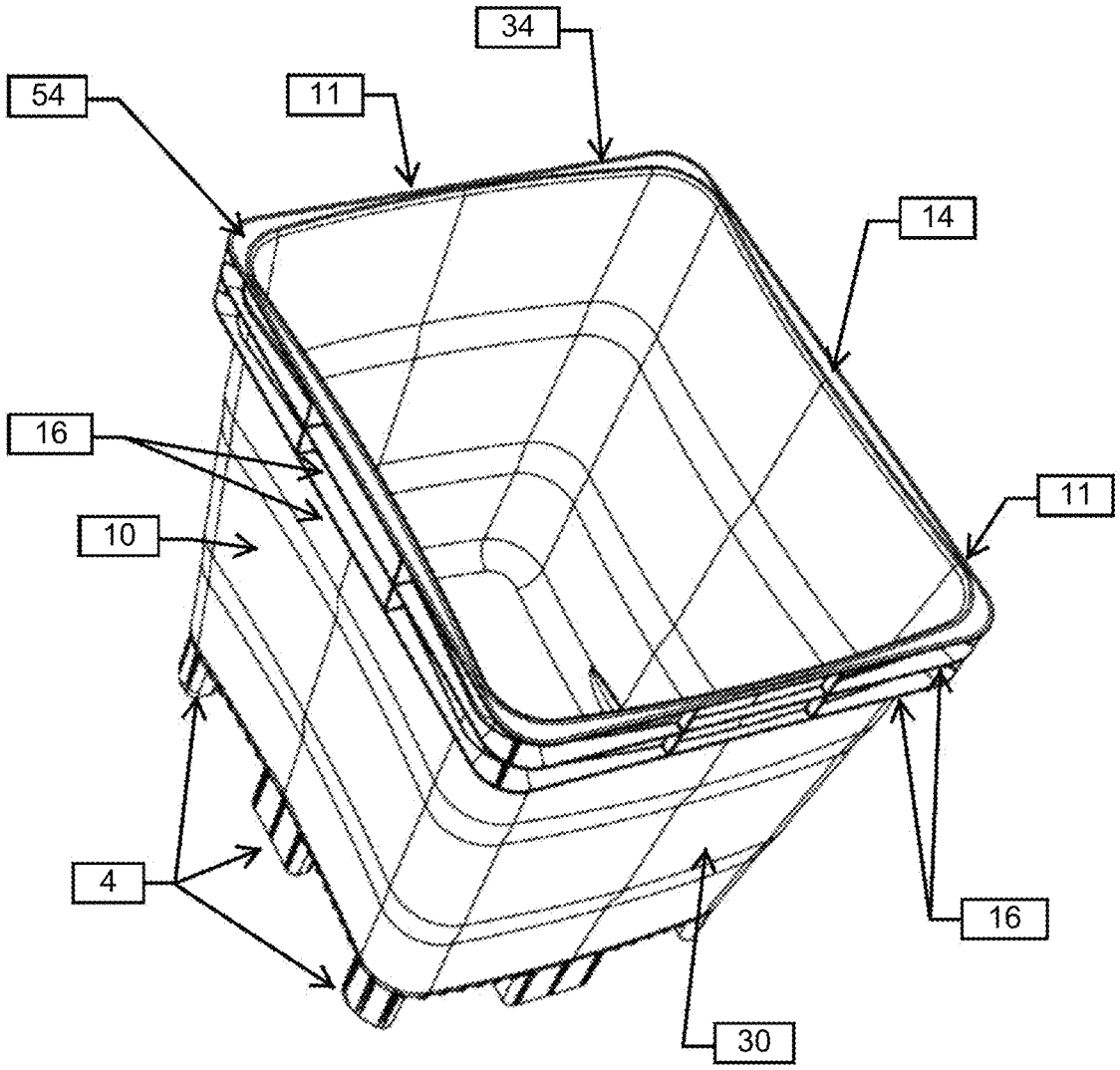
FIG. 2 is a perspective view of the embodiment from FIG. 1 at a different viewing angle.
Figure 3:
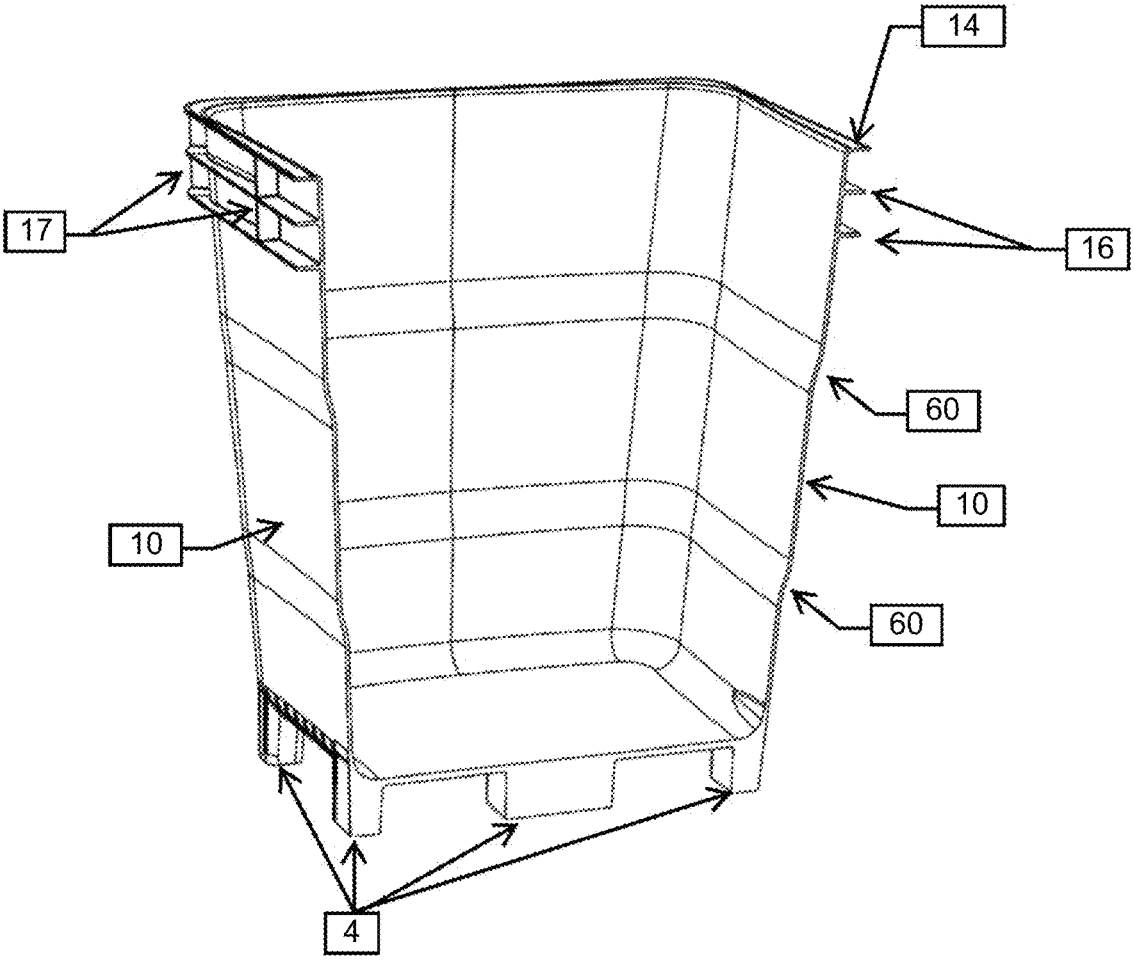
FIG. 3 is a vertical cross-section of the embodiment from FIG. 1 taken at a midpoint of the long walls.
Figure 4:
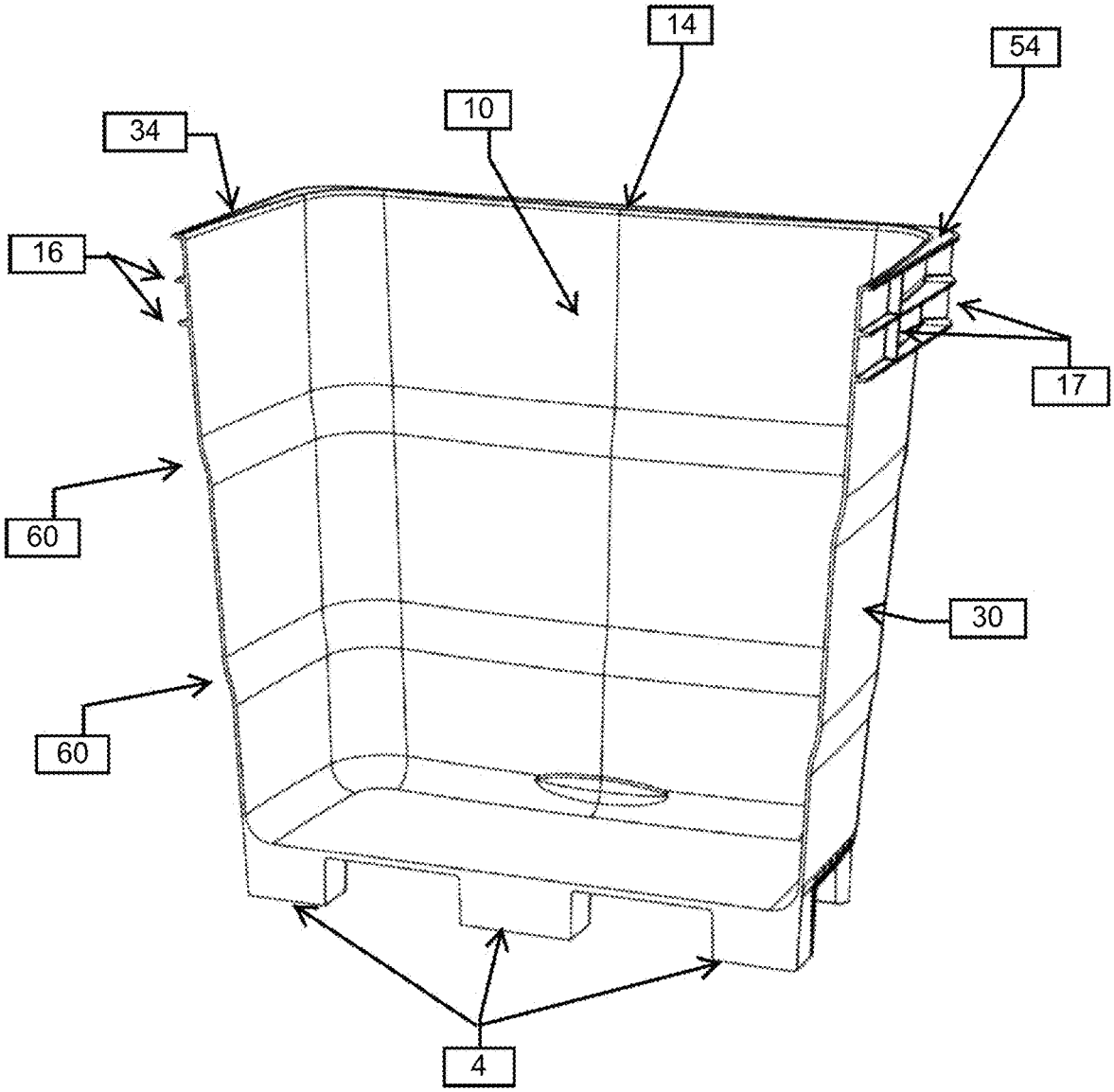
FIG. 4 is a vertical cross-section of the embodiment from FIG. 1 taken at a midpoint of the short walls.
Figure 5:
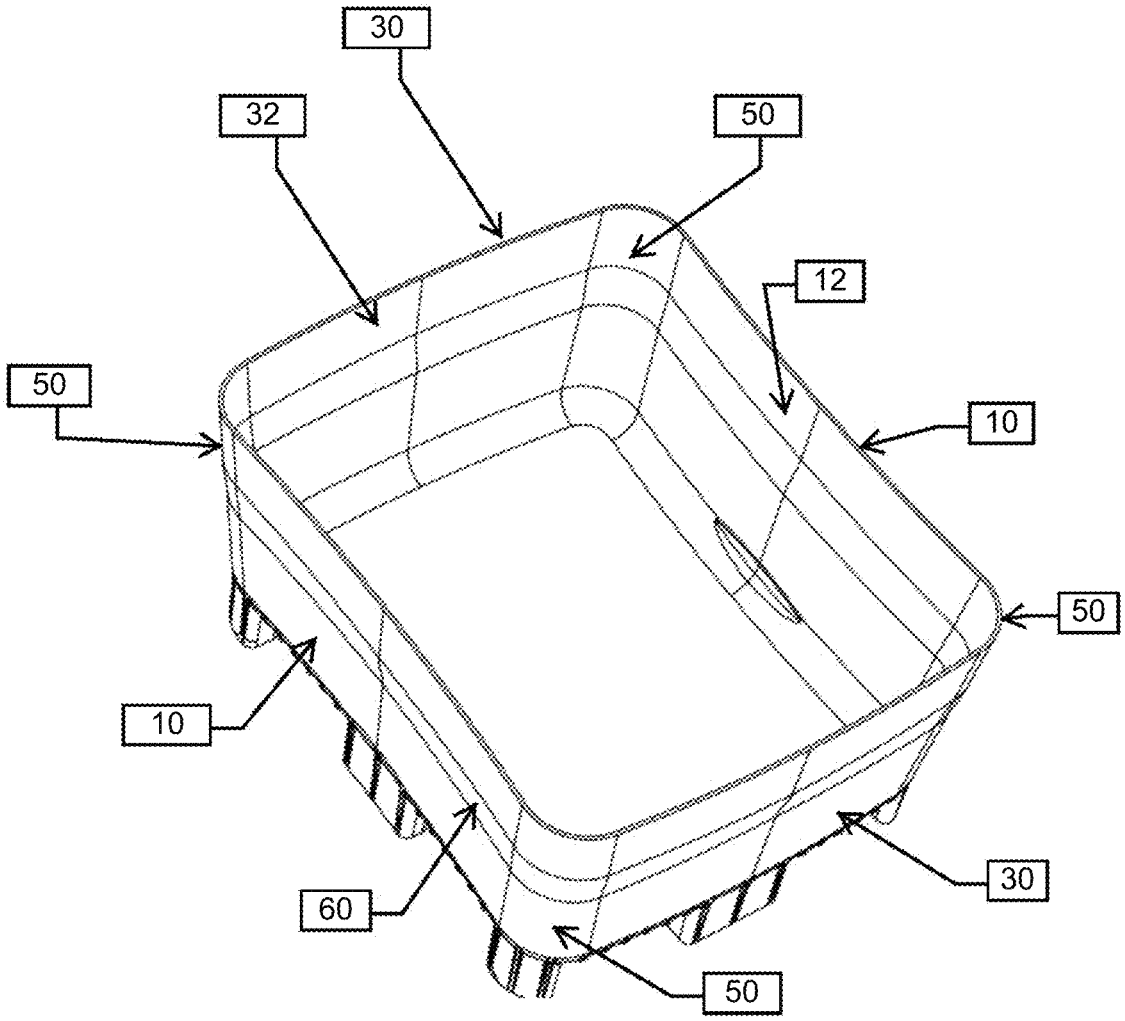
FIG. 5 is a horizontal cross-section of the embodiment from FIG. 1.

The present invention is a shipping container 1 for bulk goods and more specifically for bulk goods that are liquid, partially liquid, or otherwise amorphous (hereinafter a "hydraulic load"), which apply hydraulic pressure loading to the interior surfaces of the container. In such applications, if container 1 is rectangular with a length greater than its width, there is a tendency for long walls 10 of container 1 to want to bow out since long walls 10 experience greater hydraulic pressure than short walls 30. In contrast to long walls 10, short walls 30 have a tendency to bow in as a result of long walls 10 bowing out.

To enable container 1 to bear the hydraulic pressure of a hydraulic load, container 1 is formed with long walls 10 that are formed to have convex inner surface 12 (i.e. inner surface 12 is curved toward opposing long wall 10) to resist the tendency of long walls 10 to bow out due to hydraulic pressure. As shown in the illustrated embodiment, long walls 10 may also have a convex cross-section. The walls of container 1 may be topped with rim 11, which itself comprises rim portions 14, 34, and 54. Long walls 10 may be topped with rim portions 14. Rim portions 14 extend outward from the upper edge portions of long walls 10 and provide additional rigidity to the upper portions of long walls 10. Rim portions 14 preferably terminates in a straight edge. This has at least two benefits. First, it results in rim 11 having a greater width at the center of long walls 10, thereby adding the greatest amount of additional strength and rigidity where long walls 10 need it the most. Second, by having a straight edge, rim portions 14 will facilitate the placement of a number of containers 1 adjacent to one another in an orderly fashion.

In contrast, short walls 30 are formed to have a concave inner surface 32 (i.e. inner surface 32 of one of short walls 30 is curved away from opposing short wall 30) to enable short walls 30 to resist the tendency to bow inward due to hydraulic loading of container 1. As shown in the illustrated embodiment, short walls 30 may also have a concave cross-section. Short walls 30 may be topped with rim portions 34. Rim portions 34 extends outward from the upper edge portions of short walls 30 and provide additional rigidity to the upper portions of short walls 30. Rim portions 34 preferably terminate in a straight edge. This has at least two benefits. First, it results in rim 11 having a greater width at the end portions of short wall 30, thereby adding the greatest amount of additional strength and rigidity where short walls 30 need it most. Second, by having a straight edge, rim portions 34 will facilitate the placement of a number of containers 1 adjacent to one another in an orderly fashion.

If container 1 is square, the same principles discussed above apply. Since there are no "long" walls or "short" walls in a square container, a first pair of opposing walls would be formed with a convex inner surface as discussed with respect to long walls 10 above. The other pair of opposing walls would be formed with a concave inner surface as discussed with respect to short walls 30 above.

To further enhance the ability of container 1 to withstand the outward pressure of a hydraulic load, the adjacent ends of long walls 10 and short walls 30 cooperate to form curved sections 50 that serve to reduce force concentrations at the intersection of adjacent walls. Curved sections 50 may also be provided with rim portions 54 joining adjacent rim portions 14 and 34. It is preferable to maintain a constant radius in curved section 50 to minimize stress concentration in the corner sections of container 1. Such a configuration is illustrated in the attached figures. This constant radius is also maintained through horizontal offsets 60.

To still further enhance the ability of container 1 to withstand the outward pressure of a hydraulic load, container 1 may be provided with one or more reinforcing ribs 16 extending outward from an outer surface of container 1 below rim 11. Each reinforcing rib 16 preferably extends completely around the outer perimeter of container 1, and the outer edge of any portion of each reinforcing rib 16 preferably does not extend beyond the outer edge of rim 11. One or more vertical ribs 17 extending downward from the lower surface of rim 11 and outward from the outer surface of container 1 may be provided to add additional rigidity to rim 11 and reinforcing ribs 16.

Figure 6:
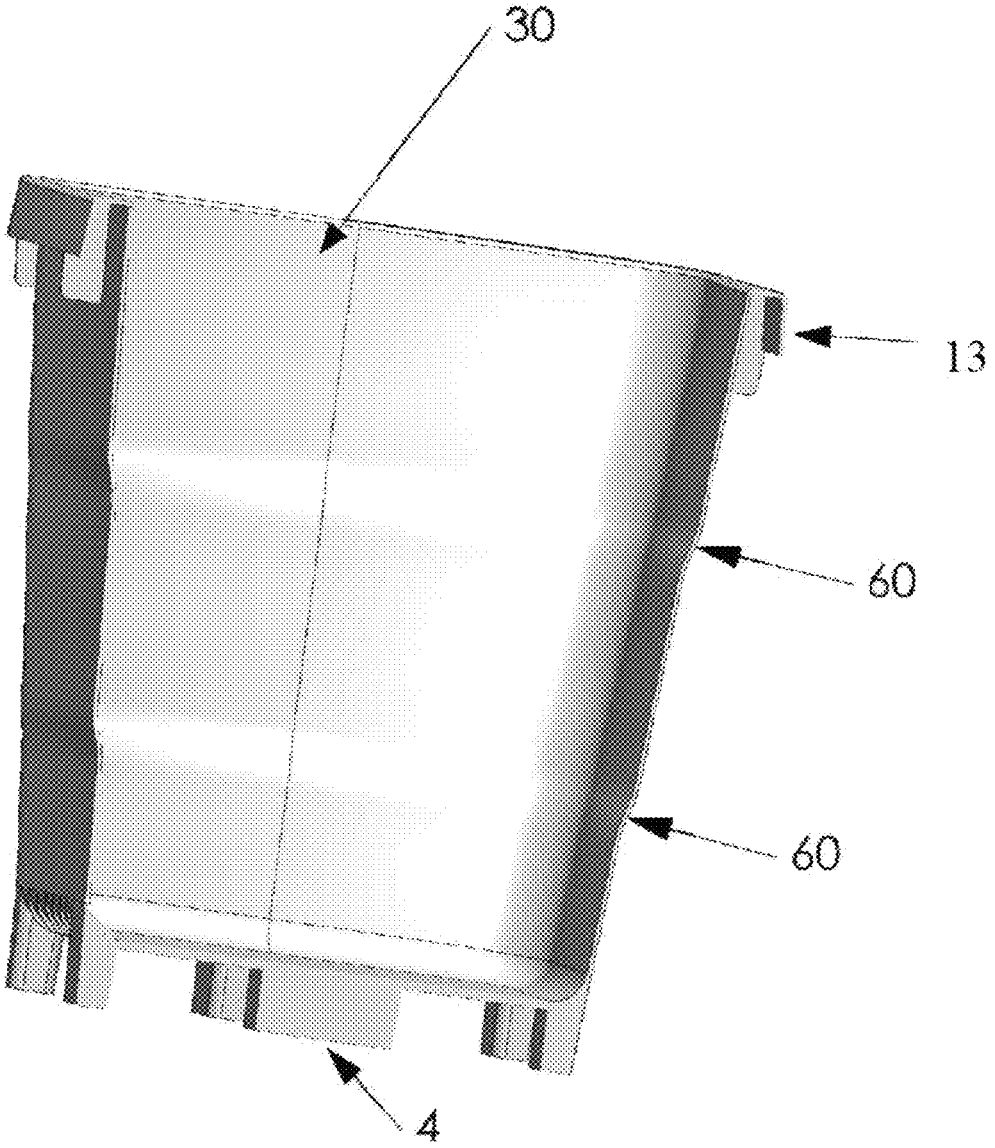
FIG. 6 is a vertical cross-section of an alternative embodiment of present invention taken at an intermediate point of the long walls.
Figure 7:
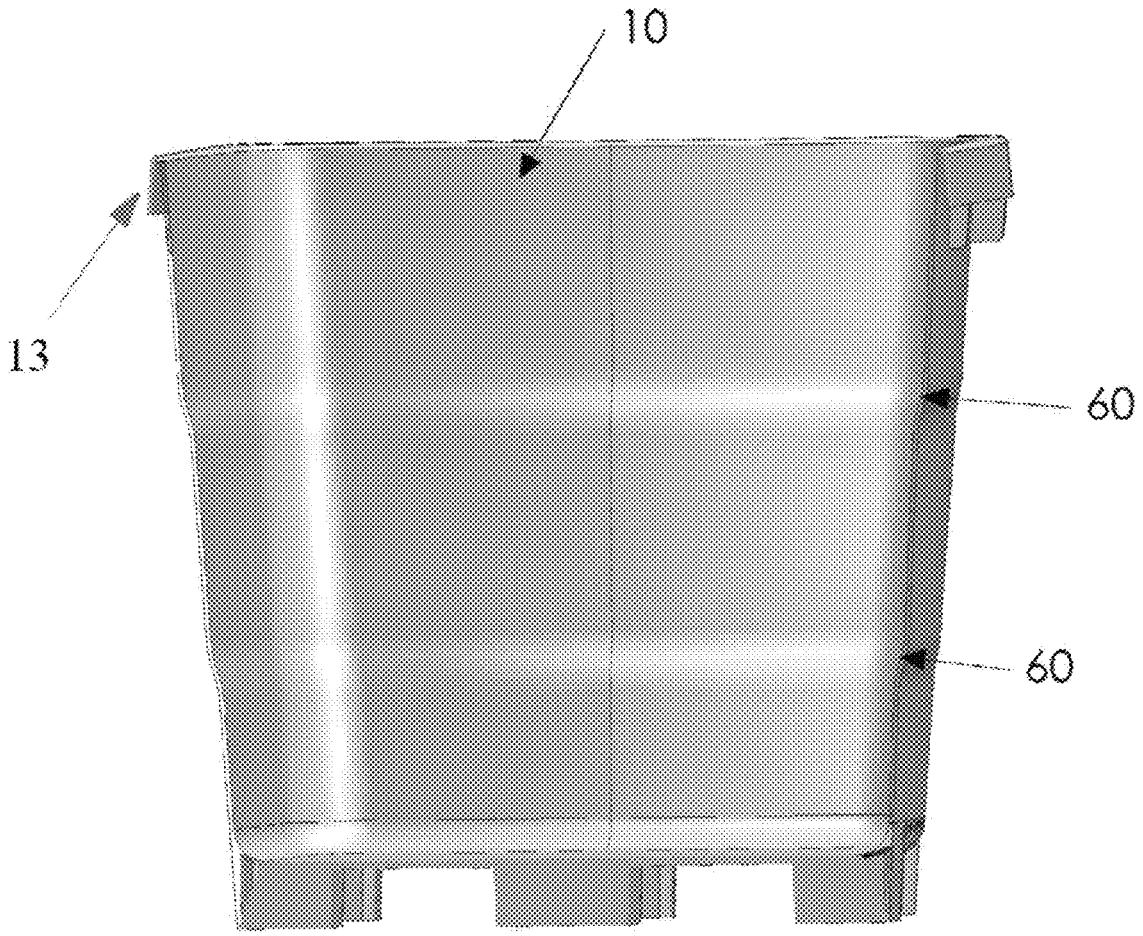
FIG. 7 is a vertical cross-section of the embodiment from FIG. 6 taken at an intermediate of the short walls.

The ability of container 1 to withstand the outward pressure of a hydraulic load may be still further enhanced by providing one or more portions of rim 11 with apron 13. Apron 13 extends downward from the outer edge portion of rim 11. Apron 13 is best seen in FIGS. 6 and 7.

Moving from top to bottom, walls 10 and 30 and corner sections 50 may also include one or more horizontal offsets 60 toward the center of container 1 (the illustrated embodiment includes two such offsets). Offsets 60 provide additional rigidity to walls 10 and 30 and corner sections 50. Offsets 60 are preferably curvilinear in shape to minimize stress concentration.

Container 1 may be designed to allow the walls to be angled outward to enable empty containers 1 to be nested together to minimize storage and transportation costs associate with the storage and shipment of empty containers. Walls 10 and 30 may also be formed integrally with base 2. Base 2 may also include a plurality of feet 4 and/or fork-straps (not shown) to facilitate movement of container 1 using material handling equipment such as forklifts and pallet jacks.

The foregoing described embodiments are exemplary in nature and are not intended to limit the scope of the invention.

I claim:

1. A shipping container comprising:

a rectangular base, said rectangular base having a first pair of opposing edge portions and a second pair of opposing edge portions;

a first pair of opposing sidewalls, each of the first pair of sidewalls arising from one of said first pair of opposing edge portions of the rectangular base, forming an obtuse angle with respect to the rectangular base, and having a convex inner surface;

a second pair of opposing sidewalls, each of the second pair of sidewalls arising from one of said first pair of opposing edge portions of the rectangular base, forming an obtuse angle with respect to the rectangular base, and having a concave inner surface, wherein adjacent sidewalls cooperate to form a curved sidewall section, said curved sidewall sections having a radius that is constant from the top of said curved sidewall sections to the bottom of said curved sidewall sections, said curved sidewall section having a concave inner face;

wherein each of the first pair of sidewalls and each of the second pair of sidewalls having at least one horizontal offset, wherein said curved sidewall sections having a radius that is constant from the top of said curved sidewall sections to the bottom of said curved sidewall sections including in said at least one horizontal offset.

2. The shipping container of claim 1, further comprising:

at least one reinforcing rib, said at least one reinforcing rib extending from an outer portion of the sidewalls and terminating in a straight edge, wherein the portion of the at least one reinforcing rib extending from the outer surfaces of the first pair of sidewalls has a width that is at its greatest at the midpoint of each of the first pair of sidewalls and the portion of the at least one reinforcing rib extending from the outer surfaces of the second pair of sidewalls has a width that is at its smallest at the midpoint of each of the second pair of sidewalls.

3. The shipping container of claim 1, wherein each of said sidewalls arise from said base at an obtuse angle resulting in said sidewalls being tapered.

* * * * *